US008387757B2

(12) United States Patent
Christy et al.

(10) Patent No.: US 8,387,757 B2
(45) Date of Patent: Mar. 5, 2013

(54) ELEVATOR CAR ASSIGNMENT CONTROL STRATEGY WITH PASSENGER GROUP SEPARATION AND FUTURE SERVICEABILITY FEATURES

(75) Inventors: Theresa M. Christy, West Hartford, CT (US); Jannah A. Stanley, Cromwell, CT (US); Wade A. Montague, Southington, CT (US); Daniel S. Williams, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 340 days.

(21) Appl. No.: 12/864,020

(22) PCT Filed: Mar. 31, 2008

(86) PCT No.: PCT/US2008/058818

§ 371 (c)(1),
(2), (4) Date: Jul. 22, 2010

(87) PCT Pub. No.: WO2009/123602

PCT Pub. Date: Oct. 8, 2009

(65) Prior Publication Data

US 2010/0294600 A1 Nov. 25, 2010

(51) Int. Cl.
*B66B 1/18* (2006.01)

(52) U.S. Cl. ..... 187/387; 187/391

(58) Field of Classification Search ..... 187/247, 187/380–388, 391–393
See application file for complete search history.

(56) References Cited

U.S. PATENT DOCUMENTS

| | | | | |
|---|---|---|---|---|
| 4,023,139 | A * | 5/1977 | Samburg | 340/506 |
| 5,159,163 | A * | 10/1992 | Bahjat et al. | 187/381 |
| 5,285,028 | A * | 2/1994 | Umeda et al. | 187/384 |
| 6,707,374 | B1 * | 3/2004 | Zaharia | 340/5.31 |
| 6,772,862 | B2 * | 8/2004 | Friedli | 187/247 |
| 7,025,180 | B2 | 4/2006 | Wyss et al. | |
| 7,093,693 | B1 * | 8/2006 | Gazdzinski | 187/384 |
| 7,353,915 | B2 * | 4/2008 | Zaharia et al. | 187/388 |
| 7,581,622 | B2 * | 9/2009 | Amano | 187/384 |
| 7,823,700 | B2 * | 11/2010 | Boss et al. | 187/384 |
| 8,061,485 | B2 * | 11/2011 | Finschi | 187/384 |
| 2003/0051947 | A1 | 3/2003 | Friedli | |
| 2003/0085079 | A1 | 5/2003 | Koehler et al. | |
| 2004/0144599 | A1 | 7/2004 | Wyss et al. | |

FOREIGN PATENT DOCUMENTS

| | | | |
|---|---|---|---|
| JP | 8277074 | A | 10/1996 |
| WO | 2007034691 | A1 | 3/2007 |

OTHER PUBLICATIONS

International Preliminary Report on Patentability for International application No. PCT/US2008/058818, mailed Oct. 14, 2010.
International Search Report and Written Opinion of the International Searching Authority for International application No. PCT/US2008/058818 mailed Dec. 8, 2008.

* cited by examiner

*Primary Examiner* — Anthony Salata
(74) *Attorney, Agent, or Firm* — Carlson, Gaskey & Olds PC

(57) ABSTRACT

An exemplary method of assigning calls to elevator cars includes ensuring that a passenger separation requirement is satisfied. The passenger separation requirement is satisfied when a passenger belonging to one service group is not carried in the same elevator car simultaneously with another passenger belonging to a different service group, for example. A call is assigned to an elevator car to carry a passenger belonging to the one service group while the elevator car is assigned to carry or is already carrying another passenger belonging to the different service group.

18 Claims, 5 Drawing Sheets

40

| | B | C | A |
|---|---|---|---|
| O | 0 | 0 | 0 |
| T | 0 | 1 | 0 |
| I | 0 | 0 | 1 |
| S | 1 | 0 | 0 |

Fig-4

50

| | B | C | A |
|---|---|---|---|
| O | 0 | 0 | 0 |
| T | 0 | 1 | 0 |
| I | 0 | 0 | 1 |
| S | 1 | 0 | 0 |

Acceptable

60

| | B | C | A |
|---|---|---|---|
| O | 0 | 0 | 0 |
| T | 0 | 0 | 0 |
| I | 0 | 0 | 1 |
| S | 1 | 0 | 0 |

Not Acceptable

70

| | B | C | A |
|---|---|---|---|
| O | 0 | 0 | 0 |
| T | 0 | 1 | 0 |
| I | 0 | 0 | 0 |
| S | 1 | 0 | 0 |

Not Acceptable

80

| | B | C | A |
|---|---|---|---|
| O | 0 | 0 | 0 |
| T | 0 | 1 | 0 |
| I | 0 | 0 | 1 |
| S | 1 | 0 | 0 |

Acceptable

Fig-5

ELEVATOR CAR ASSIGNMENT CONTROL STRATEGY WITH PASSENGER GROUP SEPARATION AND FUTURE SERVICEABILITY FEATURES

BACKGROUND

Elevator systems are well known and in widespread use. Different buildings have differing service requirements. For example, some buildings are dedicated entirely to residences while others are dedicated entirely to offices or business use. Other buildings have different floors dedicated to different types of occupancy such as a mix of business and residential within the same building.

With different building types, there are different needs associated with providing elevator service at a level that is satisfactory to the building owner and occupants. There are various elevator control strategies that are known for addressing various traffic capacity conditions. Even with the various known approaches, there are needs for customized elevator system control.

One example situation includes allowing only certain individuals to have access to certain levels within a building, for example. In some situations, it is desirable to assign passengers to elevator cars so that passengers belonging to one group or category do not travel on the same elevator as passengers belonging to a different group or category where the building owner or occupants wish to keep certain passengers from traveling on an elevator together.

One example approach is based upon a zone control for keeping an elevator assigned to service one zone from being assigned to service another zone until that elevator car has completed servicing the one zone. That approach is shown in U.S. Pat. No. 7,025,180. While that approach provides a capability for controlling which passengers travel in an elevator car with other passengers, there are limitations such as a decrease in traffic handling capacity and efficiency. It would be useful to provide an enhanced system that satisfies the desire to keep certain passengers from traveling with certain others on the same elevator car without sacrificing traffic handling capacity and efficiency.

SUMMARY

An exemplary method of assigning calls to elevator cars includes ensuring that a passenger separation requirement is satisfied. The passenger separation requirement is satisfied when a passenger belonging to one service group is not carried in the same elevator car simultaneously with another passenger belonging to a different service group, for example. A call is assigned to an elevator car to carry a passenger belonging to the one service group while the elevator car is assigned to carry or is already carrying another passenger belonging to the different service group.

An exemplary elevator system includes a plurality of elevator cars. A controller is configured to recognize different service groups. The controller ensures that a passenger separation requirement is satisfied. An example passenger separation requirement includes a passenger belonging to one service group not being carried in one of the elevator cars simultaneously with another passenger belonging to a different service group. The controller is configured to selectively assign a call to one of the elevator cars to carry a passenger belonging to the one service group while the elevator car is assigned to carry or is already carrying another passenger belonging to the different service group.

The various features and advantages of the disclosed example will become apparent to those skilled in the art from the following detailed description. The drawings that accompany the detailed description can be briefly described as follows.

BRIEF DESCRIPTION OF THE DRAWINGS

FIG. 4 schematically illustrates a car availability scenario corresponding to the operating condition of FIG. 3.

FIG. 5 schematically illustrates several car availability scenarios relative to the operating condition of FIG. 3 under several different circumstances.

DETAILED DESCRIPTION

The disclosed example elevator system and control strategy allows for ensuring that a passenger separation requirement is satisfied. An example passenger separation requirement includes a passenger belonging to one service group not being carried in an elevator car simultaneously with another passenger belonging to another service group. Calls can be assigned to an elevator car to carry a passenger belonging to the one service group while that elevator car is assigned to carry or is carrying another passenger belonging to the different service group. One way in which the disclosed example differs from previously proposed arrangements is that there is no requirement to wait for an elevator car to complete a run providing service to a passenger in one service group before being able to assign that same elevator car a call from a passenger in a different service group. The disclosed example, therefore, increases the traffic handling capacity and efficiency of the elevator system while still satisfying the passenger separation requirement.

The disclosed example allows for assigning a call to an elevator car in a manner that ensures that a future serviceability requirement is satisfied. One example future serviceability requirement includes having at least one of the plurality of elevator cars uniquely available to service a call for each of the service groups, respectively, within a selected time.

Figure 1:
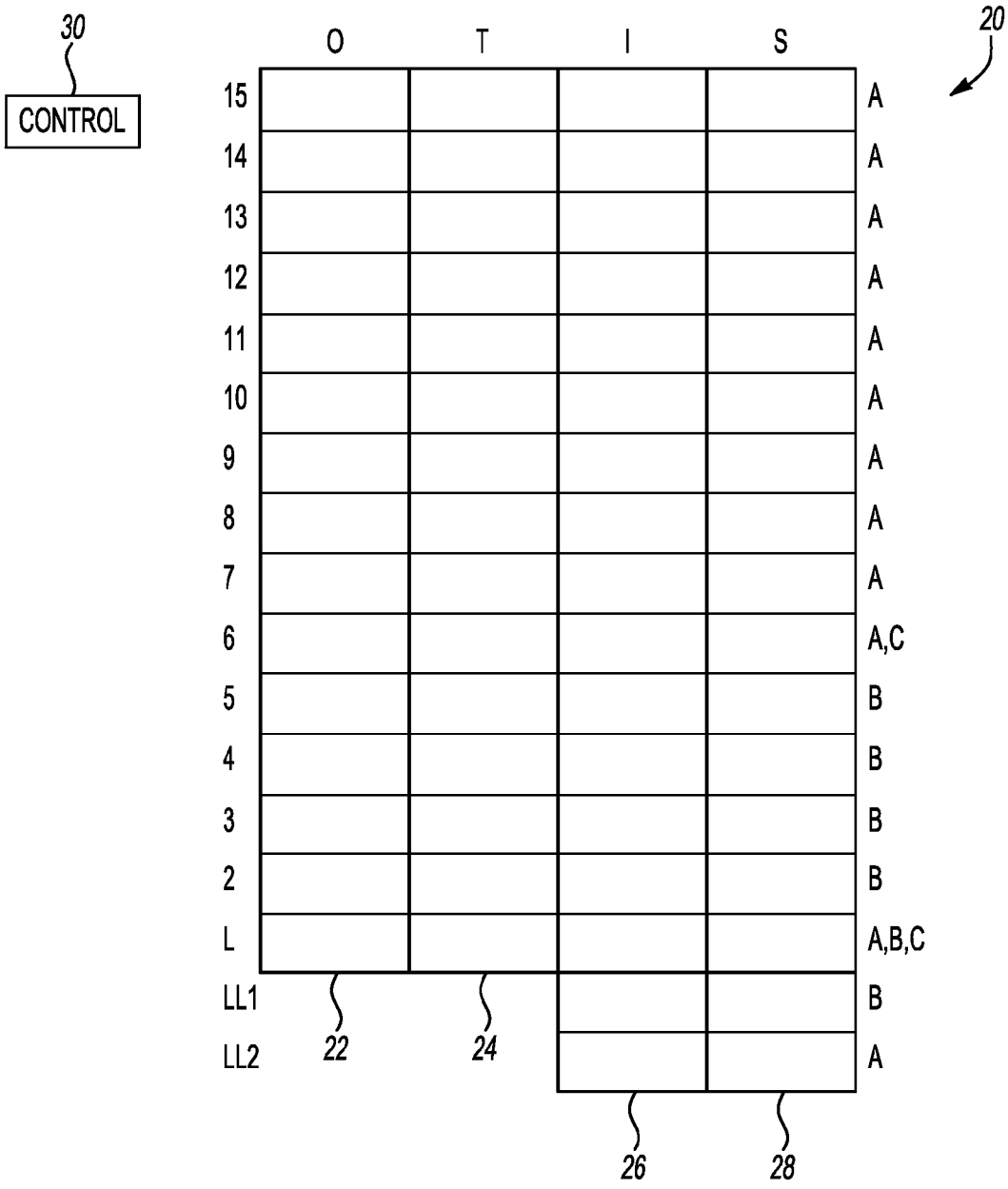
FIG. 1 schematically illustrates selected portions of an example elevator system.

FIG. 1 schematically illustrates selected portions of an example elevator system 20. This example includes four hoistways 22, 24, 26 and 28. A different elevator car is associated with each hoistway. The elevator cars are designated as car O, car T, car I and car S. As schematically shown in FIG. 1, the elevator cars O and T service the floors between the lobby L and floor 15. The elevator cars I and S service the floors from a lower level LL2 through the $15^{th}$ floor.

In this example, there are three different passenger service groups, each of which has limited access to only specific levels or areas within the corresponding building. In one example, passengers enter desired destinations prior to entering any of the elevator cars. One example system uses some form of passenger identification (e.g., an access code, electronic key or an access card) to determine the service group to which a passenger belongs. A first service group A is permitted access to the lobby L and floors 6-15 as indicated in the right hand side of FIG. 1. Individuals belonging to the service group A are also permitted access to the lowest level LL2.

Another, different service group B, is permitted access to the levels ranging from the lower level LL1 to the fifth floor.

A third, different service group C, is permitted access only to the lobby L and the floor 6.

An elevator controller 30 is configured with suitable programming such that the controller 30 assigns calls to the elevator cars O, T, I and S to allow a passenger belonging to a service group to be carried to a floor to which that passenger has authorized access. One feature of the controller is that it does not permit an elevator car to be assigned to carry a passenger to a floor where that passenger does not have authorized access. This is accomplished in this example by maintaining a passenger separation requirement that does not schedule passengers from different service groups to be carried by the same elevator car, simultaneously. In some examples, more than one service group is permitted on the same car if every such group has authorization to access a particular floor.

For example, the passenger separation requirement can be satisfied while still allowing, on an as needed basis, passengers from the service groups A and C to travel between the lobby L and the sixth floor because both service groups A and C have access to both of those floors. In other words, a passenger belonging to service group A may share an elevator car with a passenger belonging to the service group C if that elevator car is traveling between the lobby L and the sixth floor without stopping at any intervening floors. This is possible, for example, if only destination information is used to identify passengers. If additional, personal identification is obtained (e.g., an access code or card), then members of different groups may be selectively allowed onto the same car simultaneously.

The controller 30 is configured to ensure that the passenger separation requirement is satisfied and assigns calls to elevator cars to carry passengers belonging to one of the service groups while that elevator car is already assigned to carry or is already carrying another passenger belonging to a different service group. The example controller 30 is also configured to satisfy a future serviceability requirement that includes having at least one of the elevator cars O, T, I, S uniquely available to service a call for each of the service groups A, B, C, respectively, within a selected time.

For purposes of discussion, the dispatching method for making car assignments satisfies the passenger separation requirement and uses an efficiency criteria such as a known optimization, minimization or other objective function for determining which car to assign a new call. For example, a lowest remaining response time (RRT) dispatching algorithm is used in one example arrangement. As known, a lowest RRT algorithm favors assigning a call to a car that can get to the new demand in the least amount of time. That algorithm, however, is only applied to eligible cars that are available while still maintaining the passenger separation requirement. That is one way in which the disclosed example differs from a dispatching algorithm that only relies on the lowest RRT.

This example also provides the ability to satisfy a future serviceability requirement according to which each group must have at least one unique car available to service a passenger from that group within a selected time. The amount of time used for the future serviceability requirement may be configurable to meet the needs of a particular situation and may vary according to passenger service groups in some example implementations. One example selected amount of time is approximately twenty seconds. In the disclosed example, having an elevator car uniquely available means that the same car cannot be counted as uniquely available for more than one group at a time.

Figure 2:
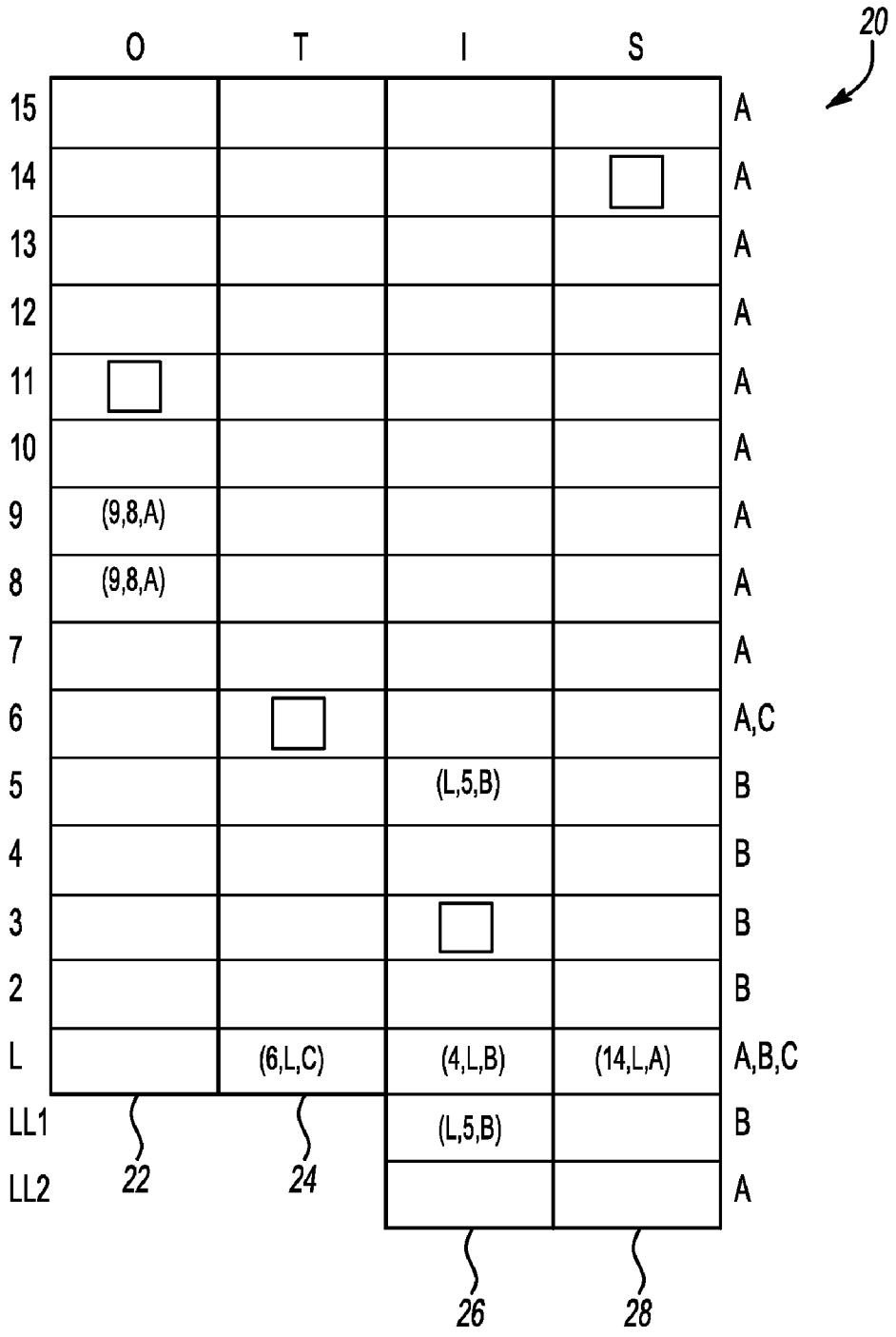
FIG. 2 schematically illustrates the arrangement of FIG. 1 during one example operating condition.

Referring to FIG. 2, one example operating condition is shown. In FIG. 2, the elevator car O is leaving floor 11 to pick up a passenger belonging to service group A on floor 9 and carry that passenger to floor 8. Car T is picking up a passenger belonging to service group C on floor 6 to carry that passenger to the lobby L. Car I is passing floor 3 carrying a passenger belonging to service group B who boarded at floor 4 and wants to go to the lobby L. Car I has also been assigned to carry a passenger belonging to group B who is waiting at the lobby L to go to floor 5. Car S is at floor 14 carrying a passenger belonging to service group A to the lobby L.

The car O is empty. The car T is carrying a passenger from group C, the car I is carrying a passenger from group B and the car S is carrying a passenger from group A. Each of the cars T, I and S are currently carrying a passenger from a different service group.

Assume that another passenger belonging to service group A arrives at the lobby L and wants to travel to floor 12. The controller 30 determines which of the elevator cars to assign to that call while maintaining the passenger separation requirement. Using a traditional car assignment approach would likely result in the new call being assigned to car I because, based upon the current situation, car I will arrive at the lobby L before any of the other cars. Such an assignment, however, would violate the passenger separation requirement because then a passenger from service group B would be carried on the same elevator car, simultaneously, as a passenger from the service group A. Car I is already assigned to transport its existing service group B passenger to the lobby and pick up another service group B passenger at the lobby. If the new call placed by the passenger belonging to the service group A were also assigned to car I, then service groups A and B would both be together on the car I. That would violate the passenger separation requirement. Accordingly, car I is not eligible for consideration in serving the new example call.

If only the rules of passenger separation are being considered, the car T will have the lowest RRT of the remaining eligible cars—O, T and S. As such, car T would be assigned to serve the call. However, the controller can also be configured to consider future serviceability as shown in the following paragraphs. In that case, the controller must consider the future serviceability before assigning a car to service the call.

Figure 3:
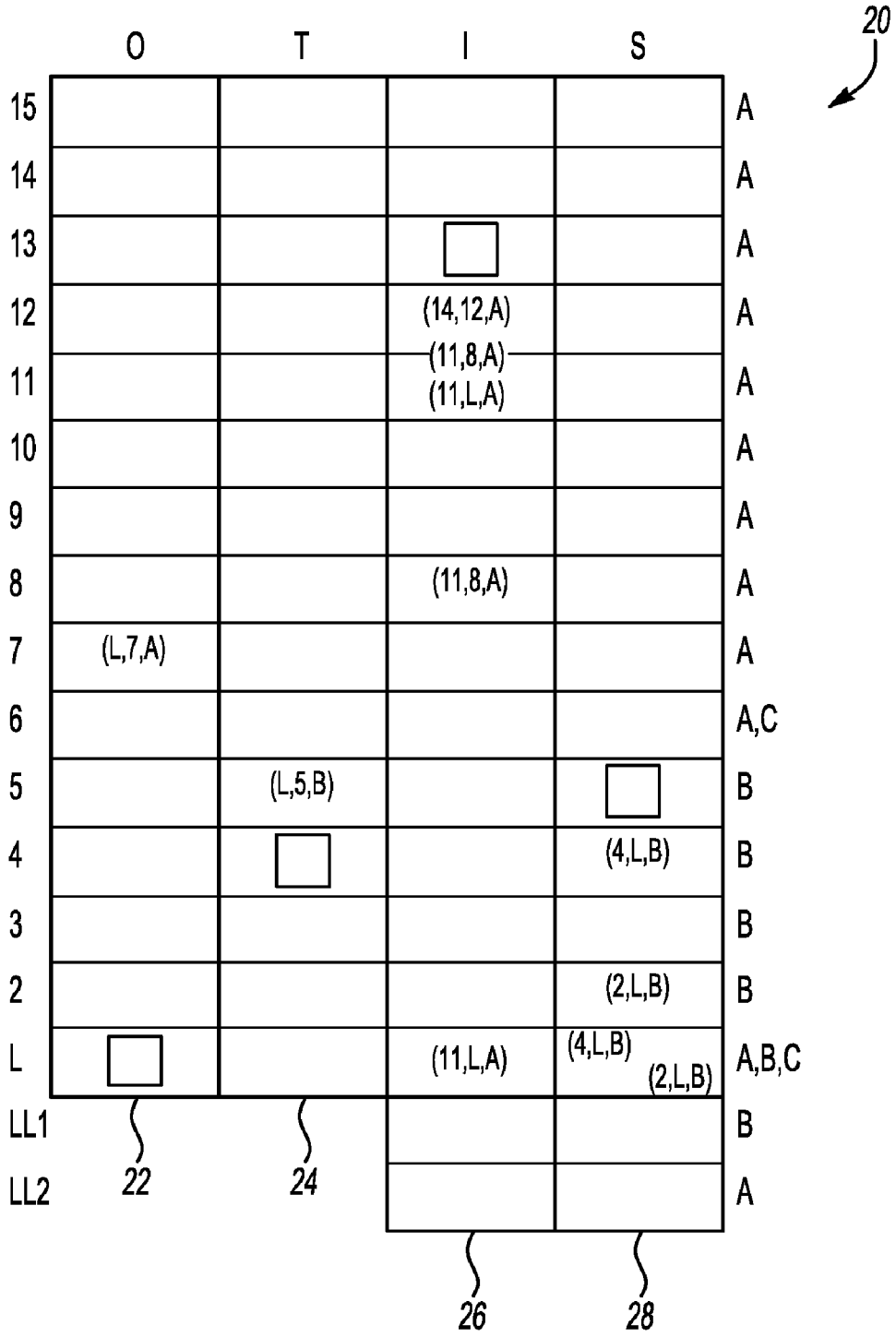
FIG. 3 schematically illustrates the example of FIG. 1 in a different operating condition.

Consider for example, FIG. 3, in which car O is at the lobby L and has loaded a passenger belonging to the service group A who is going to floor 7. Car T is passing floor 4 and heading to floor 5 where a passenger belonging to group B, who boarded at the lobby, will exit car T. Car I is passing floor 13 and scheduled to stop at floor 12 to deboard a passenger belonging to service group A, who boarded at floor 14. Car I will next complete an assignment to travel to floor 11 to pick up two more passengers belonging to service group A, one of which is traveling to floor 8 and the other of which is traveling to the lobby L. Each of those passengers will deboard at their respective intended destinations. Car S is currently passing floor 5 and scheduled to stop at floor 4 to pick up a passenger belonging to group B to carry that passenger to the lobby. Car S is also assigned to stop at floor 2 to carry another passenger belonging to group B to the lobby L. Both of those passengers will deboard car S at the lobby L.

The current status of the system's future availability can be understood by considering FIG. 4. A 3×4 matrix 40 is shown where each column indicates a passenger group and each row indicates an elevator car. If, given the existing system conditions, a particular elevator car will not be available within a selected time (such as twenty seconds) to serve a particular passenger group, then a zero is placed in the cell corresponding to that elevator car and service group combination. If the particular elevator car will be available within the selected time to potentially serve any floor of a particular service group, then a one is placed in the cell corresponding to that car and group combination. In this example, the elevator car does not have to reach the potential future demand of a particular service group within twenty seconds or complete serving the potential future demand within twenty seconds. The elevator car should, however, be available for potential assignment to any demand in a particular service group within twenty seconds in this example. The availability time (i.e., the time to be compared to the selected time) is the time that an elevator car would be available to service a particular service group without violating the passenger separation requirement.

In this example, the availability matrix is designed to ensure that the same car is not used to represent future serviceability for different passenger groups. If the same car were to be used for different groups and if there were future demand for both groups, the system may not have a car available for each group. There is at least one car available to serve each group in this example.

The example of FIG. 4 has a car uniquely available for each group. In the example of FIG. 4, the matrix 40 includes car S being available for use by passenger service group B, car T is available for use by service group C and car I could be used for the passenger service group A. The availability matrix 40 of FIG. 4 includes a unique elevator car available for each group.

In this example, there are three service groups and four potential candidate elevator cars. If the availability matrix of FIG. 4 does not include at least one 1 in each of three rows, the future serviceability requirement will not be met. One feature of this example is that there are fewer service groups than there are elevator cars and satisfying the future serviceability requirement is reasonable. There may be examples including more service groups than there are elevator cars and satisfying a future serviceability requirement such as that used in the described example may not be possible. Those skilled in the art who have the benefit of this description will be able to determine whether a future serviceability requirement is advisable, necessary and how to configure the parameters of the future serviceability requirement to meet their particular needs.

The future availability matrix of FIG. 4 indicates how soon each car would be available to service a particular group based upon the operating condition of FIG. 3, assuming that an elevator car takes one second to travel through each floor and that each elevator stop takes ten seconds. In addition, the selected time of the future serviceability requirement in this example is twenty seconds.

Considering service group A, car O can never be considered uniquely available for group A because car O is not capable of reaching the lower level LL2.

Similarly, car T can never be considered uniquely available for group A because it cannot reach the lower level LL2.

Car I may be a candidate as uniquely available for group A because it is capable of reaching all floors to which members of group A have authorized access. In the example of FIG. 3, car I is currently serving passengers belonging to group A and so is available in zero seconds for servicing a call from a passenger in group A. Accordingly, the availability matrix 40 in FIG. 4 includes a 1 in the box corresponding to car I and group A.

Car S may be a candidate uniquely available for serving service group A under some circumstances. In the example of FIG. 3, car S will be serving passengers from group B for at least 43 seconds. Therefore, car S is considered unavailable to exclusively serve passengers from group A within twenty seconds. The corresponding O entry is shown in the availability matrix 40.

Considering the service group B, cars O and T can never be uniquely available because neither can reach the lower level LL1 to which passengers belonging to service group B have authorized access. Cars I and S are potential candidates as being uniquely available for servicing group B. In the example of FIG. 3, car I will be serving passengers from group A for at least 52 more seconds. Therefore, car I cannot be considered uniquely available to service group B within twenty seconds. Car S is currently serving passengers in group B. Therefore, car S is considered available uniquely to group B within zero seconds.

Considering group C, car O is serving passengers from group A for at least 24 seconds (it must spend eight more seconds at the lobby L to complete its last stop). Therefore, car O is not considered uniquely available to serve passengers in group C within twenty seconds. Car T will be finished serving passengers from group B in eleven seconds and, therefore, is considered uniquely available to serve passengers from group C within twenty seconds (e.g., available at eleven seconds). Car I will be serving passengers from group A for at least 52 more seconds. Therefore, car I is not considered uniquely available to serve passengers from group C within twenty seconds. Car S will be serving passengers from group B for at least 43 more seconds. Therefore, car S cannot be considered uniquely available to serve group C within twenty seconds.

Given different existing car assignments and different existing parameters for the future serviceability requirement or different timings associated with the elevator cars servicing calls (i.e., floor to floor travel time or door open times), it is possible for the future availability matrix of FIG. 4 to look different even if the elevator system of FIG. 1 were used with such different parameters. In the example of FIG. 4, the passenger separation requirement and the future serviceability requirement are satisfied and the controller 30 considers the scenario of FIGS. 3 and 4 to be acceptable.

FIG. 5 schematically shows future availability matrices 50, 60, 70 and 80. In FIG. 5 each future availability matrix corresponds to assigning a new call from a passenger belonging to service group B who wants to travel from floor 5 to floor 2 given a current existing system scenario as shown in FIG. 3. The future availability matrix 50 corresponds to the new call being assigned to car O. In this example, the future serviceability requirement is satisfied and the passenger separation requirement is also satisfied so that it would be acceptable to assign the new call (i.e., carrying a passenger belonging to service group B between floors 5 and 2) to car O.

The future availability matrix 60 shows the scenario if the new call were assigned to car T. In this instance, car I is available exclusively or uniquely to the service group A and car S is uniquely available to the service group B. There is no car uniquely available to the service group C, however. Therefore, the assignment to car T cannot be made without violating the future serviceability requirement.

The future availability matrix 70 shows the results of assigning the example new call to car I. In this case, there is no car uniquely available for servicing group A and the future serviceability requirement is not satisfied. Therefore, the controller 30 will not assign the new call to car I.

The future availability matrix 80 shows the results of assigning the new call to car S. In this example, each service group has a car uniquely available to it so that the future serviceability requirement is satisfied. Additionally, the passenger separation requirement is satisfied so that assigning the new call to car S is acceptable.

In the scenario described, the new call, originating at floor 5 and traveling to floor 2, will be assigned to either of the two eligible cars; car O and car S. Since, of these two, car O has the lowest RRT, the call will be assigned to car O.

In one example, the controller 30 is configured to consider each of the example scenarios of FIG. 5 and to select the scenario that satisfies the passenger separation requirement, the future serviceability requirement and the lowest RRT algorithm. When considering the lowest RRT parameters in one example, the relevant time is not the time at which an elevator car could reach the new call. Instead, the relevant time is when an elevator car is available to proceed to the call for answering it without violating the passenger separation requirement.

In one example, the controller 30 is configured to allow for a bypass operation for purposes of answering a new call. An initial consideration of cars as candidates for answering a call in this example includes considering an elevator car as an initial candidate for assignment to a new call if picking up a passenger for that call will not force the elevator car to use a bypass operation to ensure that passengers from different service groups do not ride together in the car. In general, the controller 30 is configured to assign calls to cars that can satisfy the passenger separation requirement without using a bypass operation. A bypass operation is available, however, for situations where there is no better solution.

In one example, the bypass operation includes having an elevator car bypass a stop to serve a previously assigned demand as it passes the demand in the same direction as the demand. The elevator car will first go and complete another call and then subsequently return, at a later point, to serve the bypassed demand.

For example, the elevator car I may be carrying a passenger from group A from floor 9 to the lobby L. The elevator car I may be assigned to pick up a passenger from group B to carry that passenger from floor 5 to floor 2. The elevator car I will bypass the assigned group B call on the way to the lobby L, complete the call serving the passenger from group A at the lobby L and then return back to floor 5 to pick up the passenger from group B. In this example, the car I bypassed the group B call to pick up a passenger from floor 5 to carry that passenger in a downward direction even though car I was passing floor 5 in that same, downward direction.

In one example, if an elevator car has to perform such a bypass operation, that car is not considered as an initial candidate. The controller 30, however, will consider assigning a particular call to such an elevator car if the initial analysis without including any bypass operation, cannot satisfy the passenger separation requirement, the future serviceability requirement or both.

By considering FIGS. 3 and 5, it can be seen how a call placed by a passenger belonging to group B can be assigned to car O even while car O is carrying a passenger belonging to service group A. It is not necessary to wait for car O to complete the run for servicing the passenger from group A before making such an assignment. Such a control strategy allows all cars to be used as needed to serve existing demands instead of reserving cars for possible future use in a manner that prevents them from serving current demand. Additionally, the example method allows the new call to be assigned to the car that can best serve it instead of to one that may take longer to arrive at the new demand but fits a model of always reserving a car for possible future demand by another group other than a group currently demanding service. This increases system traffic capacity and efficiency compared to an arrangement that will not assign a call to serve a passenger from a particular group to an elevator car that is currently assigned a call or completing service for a call involving a passenger from a different service group.

Figure 6:
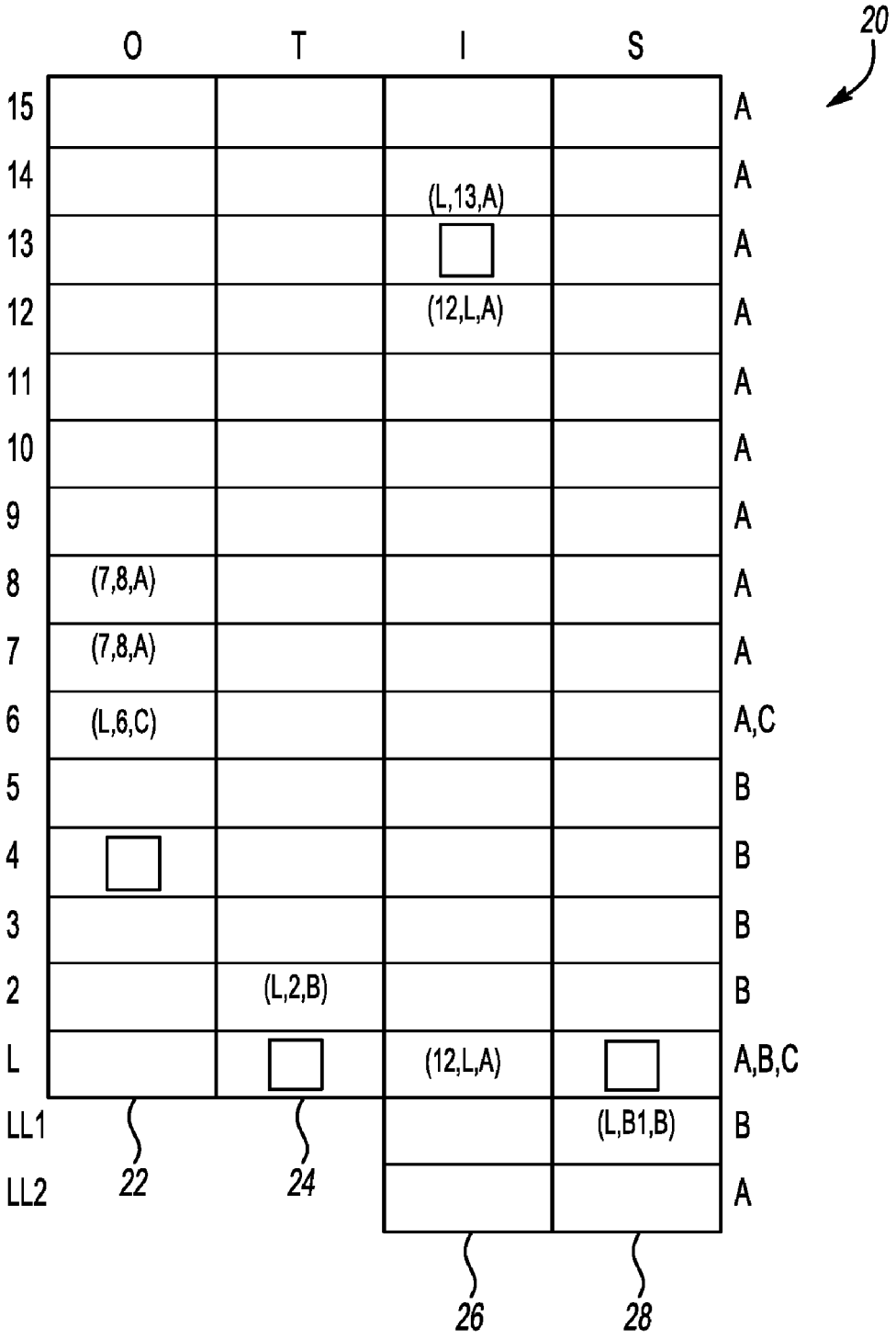
FIG. 6 schematically shows another operating condition of the example arrangement.

FIG. 6 schematically shows one example situation where at least one of the cars currently has assignments for two different passenger groups. In this example, car O is passing floor 4 and carrying two group C passengers to floor 6. Car T is leaving the lobby with a group B passenger who wants to go to floor 2. There are five group A passengers in car I, each of which will deboard at floor 13. Car I is then scheduled to stop at floor 12 to pick up another group A passenger who wants to go to the lobby. There are two group B passengers on car S, which is still at the lobby, who want to go to floor B1. Car S has nine seconds remaining before it will leave the lobby.

Assume that another group A passenger arrives at floor 7 and wants to go to floor 8. In this particular example, the passenger separation requirement is configured to not allow passengers of different groups to ride together even if they are going to the same floor. In other words, if there are cars that already have passengers from one service group other than the service group A, then those cars are not available for this assignment unless the passengers already assigned to that car will have left the elevator car before any group A passengers are loaded.

Given the situation as just described, the controller 30 must determine which car should serve the group A passenger going to floor 8. The first thing the controller 30 does is determine which cars are eligible for the new request by evaluating each car for adherence to the rules of passenger separation and future serviceability. If assigning the new service request to a particular car would violate any of these rules, then the car would be considered not eligible for the new demand.

In this example, the controller 30 knows that car O is carrying group C passengers on board and will stop at floor 6 to let those passengers deboard. Car O will then be empty and can continue in its upward direction to floor 7 to pick up the group A passenger. The car will be empty by the time it reaches floor 7 so the rule of passenger separation will not be violated. Car T is traveling from the lobby to drop off a group B passenger at floor 2. At that time car T will be empty and could travel to floor 7 to allow the group A passenger to board the empty car. Under this scenario, the rule of passenger separation will not be violated if the new demand were assigned to car T. Similar analysis shows that the same is true for cars I and S. In this example, therefore, assignment of the new demand for the group A passenger to travel from floor 7 to floor 8 can be made to any one of the four cars without violating the rule of passenger separation.

The controller 30 in this example next considers the rule of future serviceability. An assignment to any one of the cars O, T or I will allow a unique car to provide future serviceability to each service group. Assignment to car S on the other hand, will violate the rule of future serviceability because if the new group A passenger demand were assigned to car S, there would no longer be a unique car available for future service to group B according to the future serviceability requirement. Therefore, car S is not eligible for assignment to this new demand.

The next decision step taken by the controller 30 in this example is to calculate the RRT of each eligible car O, T and I. The RRT for car S is not calculated because it was already determined to be ineligible for assignment of the new demand. In the situation described above, the car O has the lowest RRT value of the three eligible cars. Therefore, the new group A passenger demand at floor 7 will be assigned to car O. In FIG. 6, the car O is currently assigned to carry a passenger from group C and a passenger from group A. The group C passenger will have left the car before the group A passenger enters the car. Therefore, this example allows for assigning demands to a single elevator car where those demands are for passengers belonging to different service groups without violating the rule of passenger separation to prevent members of different service groups from simultaneously traveling on the same car.

In another example, before the new demand for a group A passenger to travel from floors 7 to 8 is assigned, the car O is assigned to carry another group C passenger from floor 6 to the lobby. In other words, the car O is on its way to floor 6 to allow one group C passenger to deboard where it will then pick up another group C passenger and carry that passenger to the lobby. If all other conditions remain the same, the car T will have the shortest RRT and the assignment to carry the group A passenger from floor 7 to floor 8 will be given to car T. Under this scenario, the car T is currently assigned to service demands from passengers belonging to groups A and B. The passenger separation requirement will not be violated, however, because the group B passenger will deboard car T on floor 2 before car T proceeds up to floor 7 where the group A passenger will board.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of assigning calls to one of a plurality of elevator cars that are used to carry passengers belonging to different service groups corresponding to a passenger separation requirement that includes a passenger belonging to one service group not being carried in one of the elevator cars simultaneously with another passenger belonging to a different service group, comprising the steps of:

ensuring that the passenger separation requirement is satisfied:

assigning a call to an elevator car to carry a passenger belonging to the one service group while the elevator car is (i) assigned to carry or (ii) is carrying another passenger belonging to the different service group; and assigning the call to the elevator car in a manner that ensures that a future serviceability requirement is satisfied, the future serviceability requirement including having at least one of the elevator cars uniquely available to service a call for each of the service groups, respectively, within a selected time.

2. The method of claim 1, wherein the selected time is greater than a few seconds.

3. The method of claim 2, wherein the selected time is approximately 20 seconds.

4. The method of claim 1, comprising determining which of the elevator cars is eligible for the call while satisfying the passenger separation requirement and the future serviceability requirement; and assigning the call to the eligible one of the elevator cars that can answer the call with a most favorable efficiency criteria relative to another eligible car.

5. The method of claim 4, wherein the efficiency criteria is a lowest remaining response time.

6. The method of claim 1, comprising determining a time required for a candidate elevator car to service at least one call already assigned to the candidate elevator car to carry a passenger belonging to the different service group;

determining whether the determined time is less than or equal to the selected time; and determining that the candidate elevator car will be able to accept an assignment of the call only if the determined time is less than or equal to the selected time.

7. The method of claim 1, comprising determining that the elevator cars is able to accept an assignment of the call if the elevator car is currently carrying or assigned to carry other passengers only belonging to the one group.

8. The method of claim 1, wherein a number of the service groups is less than a number of the elevator cars.

9. The method of claim 1, comprising selectively bypassing a previously assigned call from a passenger belonging to the different service group;

completing the call for the passenger belonging to the one service group; and subsequently completing the previously assigned call from the passenger belonging to the different service group.

10. An elevator system, comprising:

a plurality of elevator cars; and a controller that is configured to recognize different service groups, ensure that a passenger separation requirement is satisfied, the passenger separation requirement including a passenger belonging to one service group not being carried in one of the elevator cars simultaneously with another passenger belonging to a different service group, selectively assign a call to one of the elevator cars to carry a passenger belonging to the one service group while the one of the elevator cars is (i) assigned to carry or (ii) is carrying another passenger belonging to the different service group; and assign the call to the one of the elevator cars in a manner that ensures that a future serviceability requirement is satisfied, the future serviceability requirement including having at least one of the elevator cars uniquely available to service a call for each of the service groups, respectively, within a selected time.

11. The system of claim 10, wherein the selected time is greater than a few seconds.

12. The system of claim 11, wherein the selected time is approximately 20 seconds.

13. The system of claim 10, wherein the controller is configured to determine which of the elevator cars is eligible for the call while satisfying the passenger separation requirement and the future serviceability requirement; and assign the call to the eligible one of the elevator cars that can answer the call with a most favorable efficiency criteria relative to another eligible car.

14. The system of claim 13, wherein the efficiency criteria is a lowest remaining response time.

15. The system of claim 10, wherein the controller is configured to determine a time required for a candidate elevator car to service at least one call already assigned to the candidate elevator car to carry a passenger belonging to the different service group;

determine whether the determined time is less than or equal to the selected time; and determine that the candidate elevator car will be able to accept an assignment of the call only if the determined time is less than or equal to the selected time.

16. The system of claim 10, wherein the controller is configured to determine that one of the elevator cars is able to accept an assignment of the call if the one of the elevator cars is currently carrying or assigned to carry other passengers that only belong to the one group.

17. The system of claim 10, wherein a number of the service groups is less than a number of the elevator cars.

18. The system of claim 10, wherein the controller is configured to cause the one of the elevator cars to:

selectively bypass a previously assigned call from a passenger belonging to the different service group;

complete the call for the passenger belonging to the one service group; and subsequently complete the previously assigned call from the passenger belonging to the different service group.

* * * * *